US008146788B2

(12) United States Patent
Hlinka et al.

(10) Patent No.: US 8,146,788 B2
(45) Date of Patent: Apr. 3, 2012

(54) FASTENING TOOL WITH RELEASABLE WORK CONTACT ELEMENT

(75) Inventors: Eric E. Hlinka, Roselle, IL (US); Chia Sheng Liang, Taipei (TW); Chu Hsiang Tseng, Taipei County (TW); Chin Lung Chang, Taoyuan County (TW)

(73) Assignee: Robert Bosch GmbH, Stuttgart (DE)

( * ) Notice: Subject to any disclaimer, the term of this patent is extended or adjusted under 35 U.S.C. 154(b) by 101 days.

(21) Appl. No.: 12/630,896

(22) Filed: Dec. 4, 2009

(65) Prior Publication Data

US 2011/0132958 A1 Jun. 9, 2011

(51) Int. Cl.
*B25F 5/00* (2006.01)
*B25C 1/00* (2006.01)

(52) U.S. Cl. ..... 227/8; 227/107

(58) Field of Classification Search ..... 227/8–10, 227/120, 130

See application file for complete search history.

(56) References Cited

U.S. PATENT DOCUMENTS

| | | | | |
|---|---|---|---|---|
| 3,784,077 | A | 1/1974 | Burke, Jr. et al. | |
| 4,509,668 | A * | 4/1985 | Klaus et al. | 227/8 |
| 5,069,379 | A * | 12/1991 | Kerrigan | 227/131 |
| 5,366,132 | A | 11/1994 | Simonelli | |
| 5,385,286 | A * | 1/1995 | Johnson, Jr. | 227/8 |
| 6,179,192 | B1 * | 1/2001 | Weinger et al. | 227/8 |
| 6,371,348 | B1 | 4/2002 | Canlas et al. | |
| 6,427,896 | B1 * | 8/2002 | Ho et al. | 227/142 |
| 6,783,044 | B2 | 8/2004 | Perra et al. | |
| 6,820,788 | B2 * | 11/2004 | Akiba | 227/8 |
| 6,966,476 | B2 * | 11/2005 | Jalbert et al. | 227/8 |
| 6,966,477 | B1 * | 11/2005 | Chien-Kuo et al. | 227/8 |
| 7,213,732 | B2 | 5/2007 | Schell et al. | |
| 7,431,103 | B2 | 10/2008 | Schell et al. | |
| 7,677,425 | B2 * | 3/2010 | Brendel et al. | 227/8 |
| 7,748,586 | B2 * | 7/2010 | Akiba | 227/10 |
| 7,810,688 | B2 * | 10/2010 | Wu et al. | 227/8 |
| 7,922,054 | B2 * | 4/2011 | Cole, Jr. | 227/8 |
| 2005/0218176 | A1 | 10/2005 | Schell et al. | |
| 2006/0091177 | A1 * | 5/2006 | Cannaliato et al. | 227/8 |
| 2007/0175943 | A1 | 8/2007 | Schell et al. | |
| 2008/0135596 | A1 * | 6/2008 | Wu et al. | 227/8 |
| 2008/0296337 | A1 * | 12/2008 | Yang | 227/8 |
| 2008/0308592 | A1 | 12/2008 | Schell et al. | |
| 2009/0039132 | A1 * | 2/2009 | Kubo | 227/8 |
| 2009/0127310 | A1 * | 5/2009 | Yu | 227/8 |
| 2011/0057014 | A1 * | 3/2011 | Yang et al. | 227/8 |

* cited by examiner

*Primary Examiner* — Lindsay Low
(74) *Attorney, Agent, or Firm* — Maginot, Moore & Beck

(57) ABSTRACT

A tool for driving fasteners includes a work contact element configured to move between a first position and a second position. The tool is prevented from driving fasteners when the work contact element is in the first position. The tool further includes an extension member rigidly connected to the work contact element in a releasable connection arrangement. The releasable connection arrangement is configured to maintain a rigid connection between the work contact element and the extension member during normal operation of the tool. The releasable connection arrangement is further configured to release the rigid connection between the work contact element and the extension member during high impact events that are not associated with normal operation of the tool.

10 Claims, 6 Drawing Sheets

FASTENING TOOL WITH RELEASABLE WORK CONTACT ELEMENT

FIELD

This application relates to the field of power tools and particularly to devices used to drive fasteners into workpieces.

BACKGROUND

Fasteners such as nails and staples are commonly used in projects ranging from crafts to building construction. While manually driving such fasteners into a work piece is effective, a user may quickly become fatigued when involved in projects requiring a large number of fasteners and/or large fasteners to be driven into a work piece. Moreover, proper driving of larger fasteners into a work piece frequently requires more than a single impact from a manual tool.

In response to the shortcomings of manual driving tools, power-assisted devices for driving fasteners into work pieces have been developed. Contractors and homeowners commonly use such devices for driving fasteners ranging from brad nails used in small projects to common nails which are used in framing and other construction projects. Compressed air has been traditionally used to provide power for the power-assisted (pneumatic) devices. However, other power sources have also been used, such as DC motors.

Various safety features have been incorporated into pneumatic and other power nailers. One such device is commonly referred to as a work contact element (WCE). A WCE is incorporated into nail gun designs to prevent unintentional firing of the nail gun. A WCE is typically a spring loaded mechanism which protrudes outwardly from the nose portion of the nail gun from which a nail is driven. In operation, the WCE is pressed against a work piece into which a nail is to be driven. As the WCE is pressed against the work piece, the WCE compresses the spring and generates an axial movement which is transmitted to a trigger assembly via an extension member which links the WCE and the trigger assembly. The axial movement is used to reconfigure a safety device, which is typically a trigger disabling mechanism, so as to enable initiation of a firing sequence with the trigger of the nail gun.

The WCE is typically provided as relatively thin but rigid member such as a wireform or a stamped metal part. During normal operation, the WCE experiences only minimal impact forces as it is pressed against a workpiece in order to release the trigger disabling mechanism. These normal operating forces do not typically result in damage to the WCE. Instead, the WCE is sufficiently robust to absorb normal operating forces and serve its purpose over the life of the tool. However, in some situations, the WCE may experience high impact events where high impact forces are imparted to the WCE, such as when the tool is dropped by the user.

Because of the geometry of the WCE, it may bend, deform or experience other damage when the WCE is exposed to high impact forces. Depending on the severity of the impact force, the damage to the WCE may result in a tool that is unusable. In these situations, the WCE may need to be replaced to allow the tool to return to normal operation. However, the arrangement of the WCE and rigidly connected extension member may make it difficult to easily replace the WCE in the tool.

In view of the foregoing, it would be advantageous to provide a WCE that is capable of withstanding relatively high impact forces. It would also be advantageous if the WCE could be easily replaced in the event of any damage to the WCE.

SUMMARY

In accordance with one embodiment of the disclosure, there is provided a tool for driving fasteners, the tool including a work contact element configured to move between a first position and a second position, wherein the tool is prevented from driving fasteners when the work contact element is in the first position. The tool further includes an extension member rigidly connected to the work contact element in a releasable connection arrangement. The releasable connection arrangement is configured to maintain a rigid connection between the work contact element and the extension member during normal operation of the tool. The releasable connection arrangement is further configured to release the rigid connection between the work contact element and the extension member during high impact events that are not associated with normal operation of the tool.

Pursuant to another embodiment of the disclosure, a tool for driving fasteners includes a driver assembly configured to fire one of the fasteners from the tool. The tool further includes a work contact element configured to move in a linear direction between an extended position and a depressed position. A drive prevention arrangement is configured to prevent the driver assembly from firing one of the fasteners unless the work contact element is in the depressed position. An extension member is releasably connected to the work contact element and configured to move in the linear direction with the work contact element. The work contact element is releasable from the extension member such that the work contact element moves relative to the extension member when a force greater than a threshold force is applied to the work contact element.

In accordance with yet another embodiment of the disclosure, there is provided a tool for driving fasteners comprising a moveable work contact element and an extension member rigidly connected to the work contact element in a releasable connection arrangement. The extension member is configured to remain rigidly connected to the work contact element and move from a first position to a second position when a force less than a threshold force is applied to the work contact element. The work contact element is further configured to release from the extension member when a force greater than the threshold force is applied to the work contact element. The tool further comprises a driver assembly configured to expel one of the fasteners from the tool only if the extension member is in the second position.

The above described features and advantages, as well as others, will become more readily apparent to those of ordinary skill in the art by reference to the following detailed description and accompanying drawings. While it would be desirable to provide a fastening tool that provides one or more of these or other advantages and features, the teachings disclosed herein extend to those embodiments which fall within the scope of the appended claims, regardless of whether they accomplish one or more of the above-mentioned advantages or include the above-mentioned features.

DESCRIPTION

Figure 1:
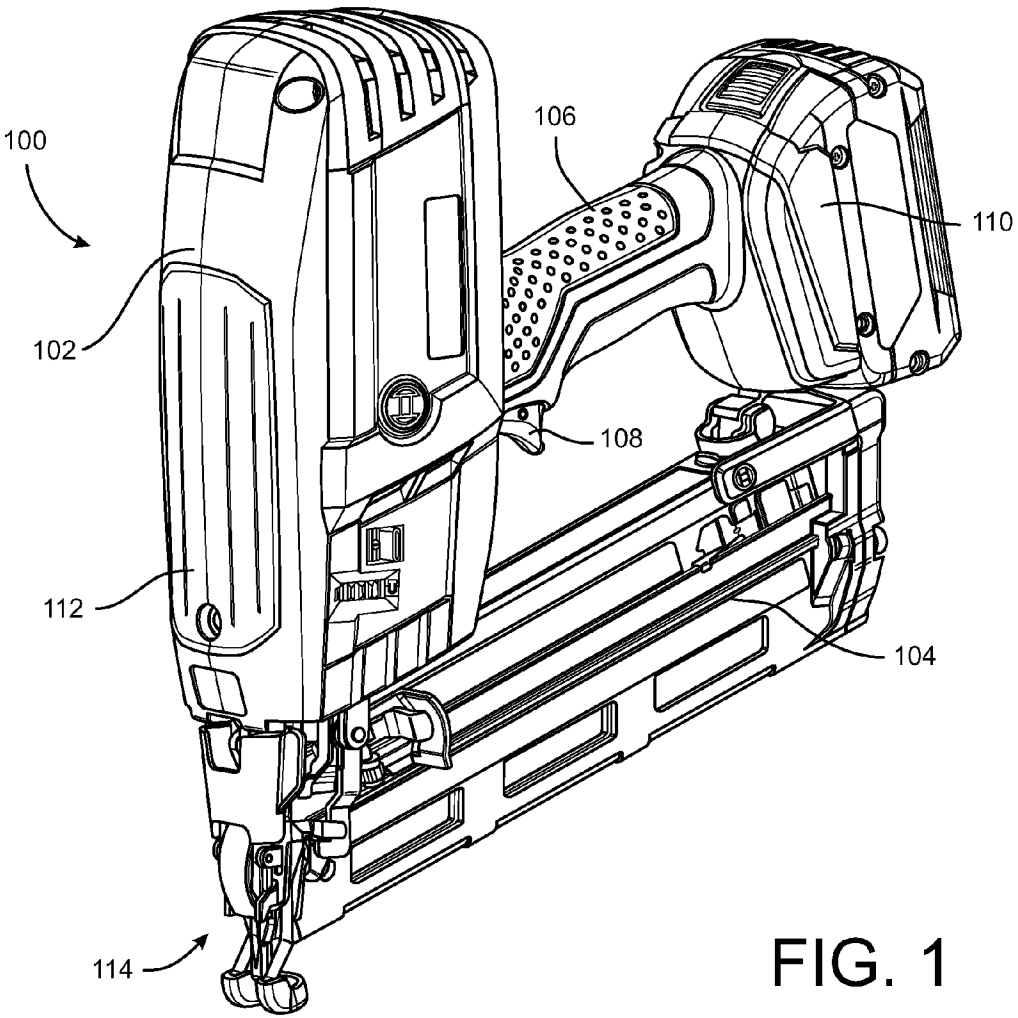
FIG. 1 depicts a side perspective view of an exemplary embodiment of a fastening tool with a releasable work contact assembly.

With reference to FIG. 1, a fastening tool 100 includes a housing 102 and a fastener storage and feeding device 104. The term "magazine" as used herein refers to any such fastener storage and feeding device. The drive housing 102 defines a handle portion 106 from which a trigger 108 extends, a receptacle area 110 and a drive section 112. The fastener guide 104 in this embodiment is spring biased to force fasteners, such as nails or staples held in a cartridge or a clip, serially one after the other, into a loaded position adjacent the drive portion 112. The receptacle area 110 may be used to connect a source of compressed air or other source of power (such as a battery) to the device 100. Located adjacent to the drive portion 112 and the magazine 104 is a nose assembly 114.

Figure 2:
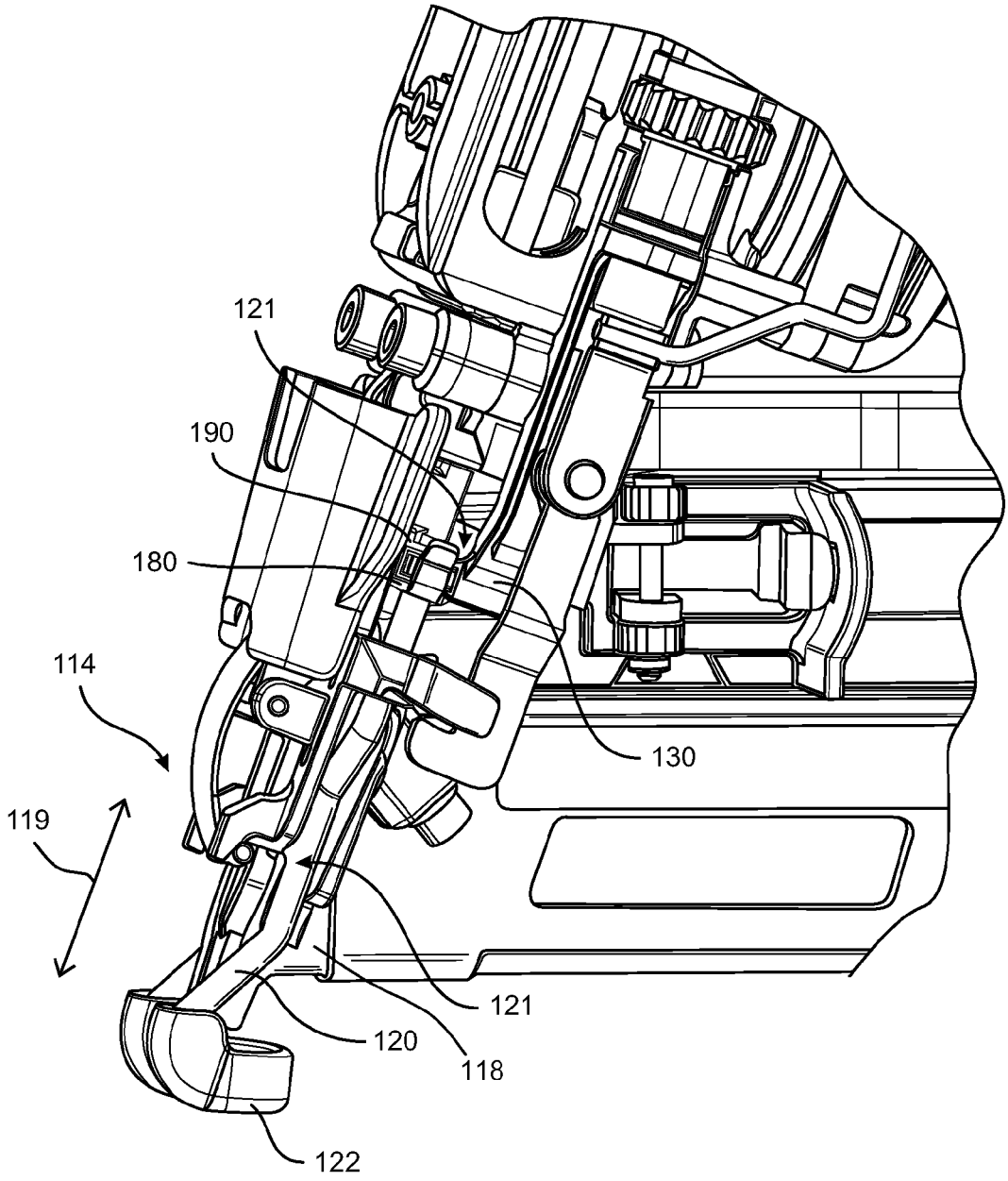
FIG. 2 depicts a perspective view of the nose assembly of the fastening tool of FIG. 1 with the housing removed and a work contact element in an extended position and coupled to an extension member.

FIG. 2 shows a cutaway view of the nose assembly 114. The nose assembly 114 includes a work contact element (WCE) 120 configured to slide along a nose frame 118 which is fixed to the housing 102. The WCE 120 is configured to slide relative to the housing 102 and nose frame 118 in an axial direction between an extended position and a retracted/depressed position, as indicated by arrow 119 in FIG. 2. The WCE 120 is connected to a WCE arm 130 to form a WCE assembly 121. Although the terms "work contact element" is used herein to refer to such safety devices that move when contacted with a work piece, it will be recognized that other names are commonly used for the WCE, such as a "contact trip", and the term "work contact element" is intended to refer to all such devices. Furthermore, although exemplary embodiments of the WCE and WCE assembly are disclosed herein, it will be recognized that numerous other embodiments are possible.

Figure 3:
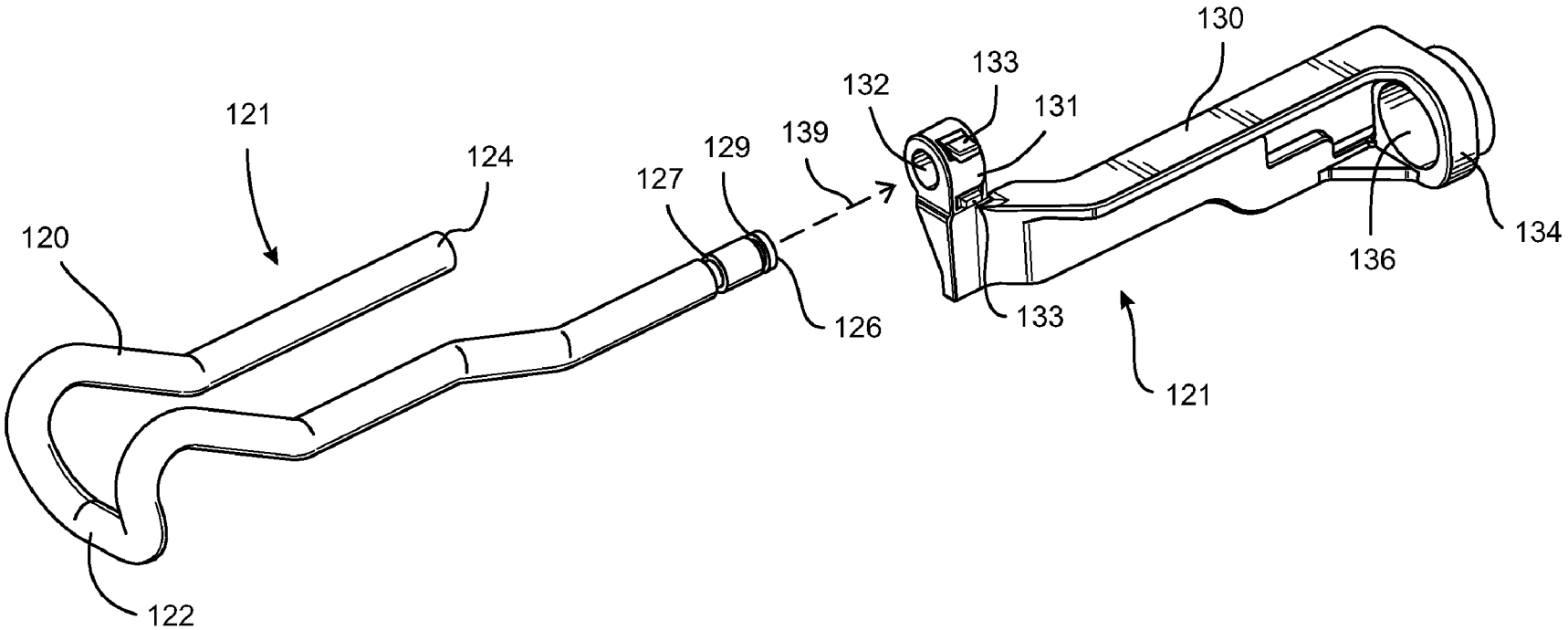
FIG. 3 depicts an isolated view of the work contact element of FIG. 2 released from the extension member which together form a work contact assembly.

FIGS. 2-5 show one embodiment of the WCE assembly 121. As best shown in FIG. 3, the WCE 120 in this embodiment is provided as a wireform bent in a shape such that a blunt contact tip 122 is formed between the two ends 124 and 126 of the wireform. One end 126 of the wireform includes two annular grooves 127 and 129. This end 126 is configured for releasable connection to the WCE extension member 130.

With continued reference to FIG. 3, the WCE extension member 130 is provided as an extension arm. The extension arm 130 includes a knob 131 on one end of the arm 130. A cylindrical channel 132 is provided by a bore formed in the knob 131. The channel 132 is configured to receive the end 126 of the WCE 120. Two tabs 133 are positioned on the outer surface of the knob 131 near the channel 132. On the opposite end of the arm 130 from the knob 131, a circular guide 134 is provided. The circular guide 134 defines a hole 136 configured to engage a depth adjustment mechanism and generally attach the WCE assembly 121 to other components of the tool 100. Examples of such additional components are disclosed in U.S. patent application Ser. No. 12/559,724, filed Sep. 15, 2009, the contents of which are incorporated herein by reference.

The WCE 120 is releasably connected to the WCE extension arm 130. In particular, as indicated by arrow 139 in FIG. 3, the end 126 of the WCE 120 is configured to slide into the channel 132 of the extension arm 130. The grooves 127 and 129 of the WCE 120 are separated such that the upper groove 129 can be positioned outside of the upper opening to the channel 132 of the arm 130, and the lower groove 127 can be positioned outside of the lower opening to the channel 132 of the arm 130 when the WCE is inserted into the channel 132.

Figure 4:
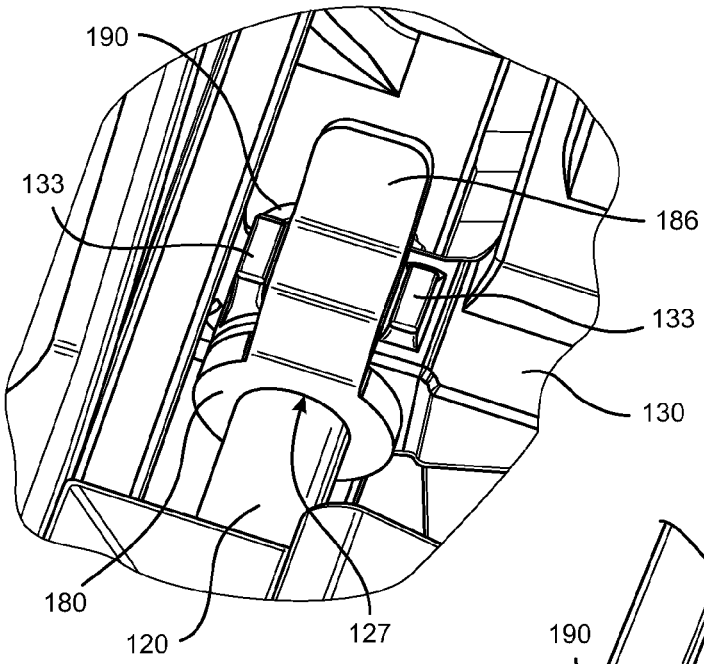
FIG. 4 depicts a lower perspective view of a releasable connection arrangement for work contact assembly of FIG. 3.
Figure 5:
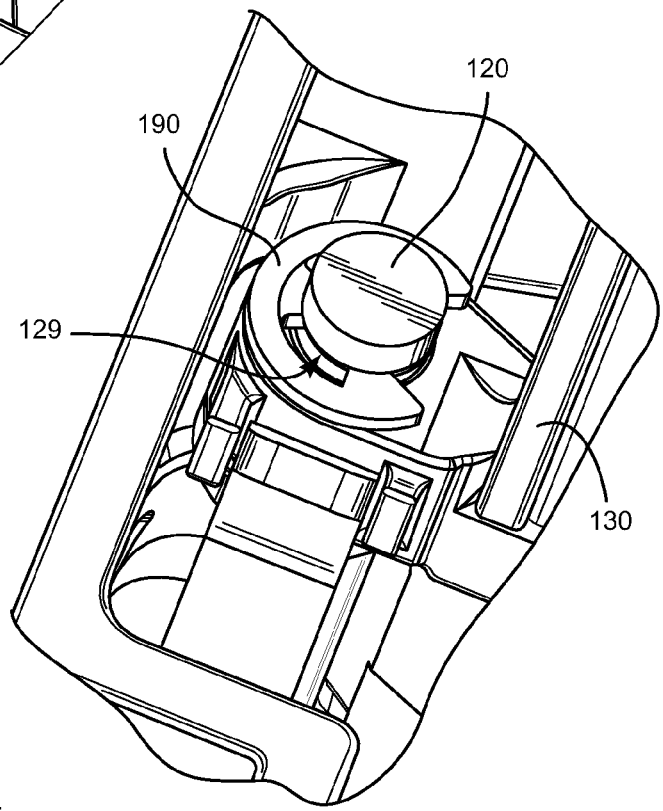
FIG. 5 depicts an upper perspective view of the releasable connection arrangement of FIG. 4.

As shown in FIGS. 4 and 5, two clips 180 and 190 are used in association with the grooves 127 and 129 of the WCE 120 to retain the WCE 120 in place on the arm 130 during normal operation of the tool 100. Clip 180 is configured to engage the lower groove 127 of the WCE 120, as shown in FIG. 4. Similarly, clip 190 is configured to engage the upper groove 129 of the WCE 120, as shown in FIG. 5.

Figure 6:
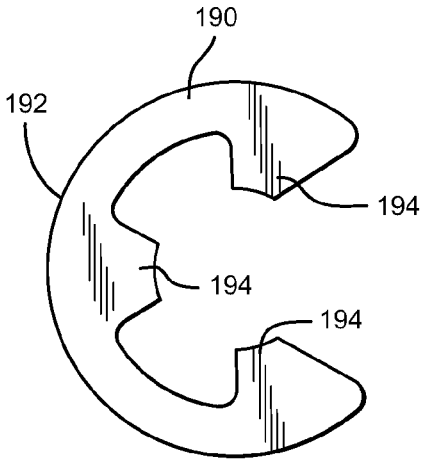
FIG. 6 depicts a top view of a clip used to provide the releasable connection arrangement of FIG. 4.

As best seen in FIG. 6, the clip 190 is an E-ring clip. The E-ring clip 190 includes a substantially circular perimeter portion 192 with three protrusions 194 extending inwardly. These protrusions 194 are configured to extend into the groove 129 of the WCE 120 and grip the WCE when the clip 190 is inserted onto the WCE. In other embodiments, the clip 190 could be configured differently, such as a C-ring or other releasable clip.

Clip 180 is similar in shape to clip 190, and includes the same E-ring configuration. However, clip 180 also includes a finger 186 that extends outward from the E-shaped portion of the clip. The finger 186 is designed and dimensioned to fit between the tabs 133 of the WCE extension arm 130. Placement of the finger 186 between the tabs 133 prevents the clip 180 from rotating relative to the WCE 120 and WCE extension arm 130. Additionally, the finger 186 provides a surface for a human to grasp when inserting or removing the clip 180 on the WCE 120.

In operation, the clips 180 and 190 provide a releasable connection arrangement for the work contact assembly 121. In particular, when the WCE 120 is inserted into the channel 132 of the extension arm 130 and the E-rings 180 and 190 are installed in the grooves 127 and 129 of the WCE 120, the WCE 120 is rigidly connected to the extension arm 130. The E-ring 190 on upper side of the knob 131 prevents the WCE 120 from sliding out of the channel 133 and falling off the tool 100. The E-ring 180 on the lower side of the knob 131 is used to transfer motion from the WCE 120 to the WCE arm 130 when the WCE 120 is moved in the axial direction from the extended position to the depressed position (i.e., along line 119 of FIG. 2), During normal working conditions and forces, the E-rings 180 and 190 transfer all motion and forces from the WCE 120 to the WCE arm 130. However, when a high impact force in excess of a threshold force is applied to the WCE 120, the E-ring 180 is forcibly jammed against the knob 131 of the extension arm 130 with such a force that the E-ring 180 breaks away from the WCE 120. Such a high impact force may be experienced, for example, when the user drops the tool 100 from a significant height, and the tool lands on the WCE 120, forcing the WCE 120 in the direction of arrow 119

(see FIG. 2). When the E-ring 180 breaks away from the WCE 120, the WCE 120 moves freely along the longitudinal axis of the channel 132, allowing the nose 114 of the tool 100 to absorb the impact without significant damage to the WCE 120. After the impact, the WCE 120 may be reset into the original position by assembling a new E-ring 180 in slot 127 of the WCE 120. Advantageously, the E-ring 180 is a relatively small part that may be comprised of a relatively inexpensive material, such as a stamped steel or molded part, making the E-ring relatively inexpensive to replace.

Figure 7:
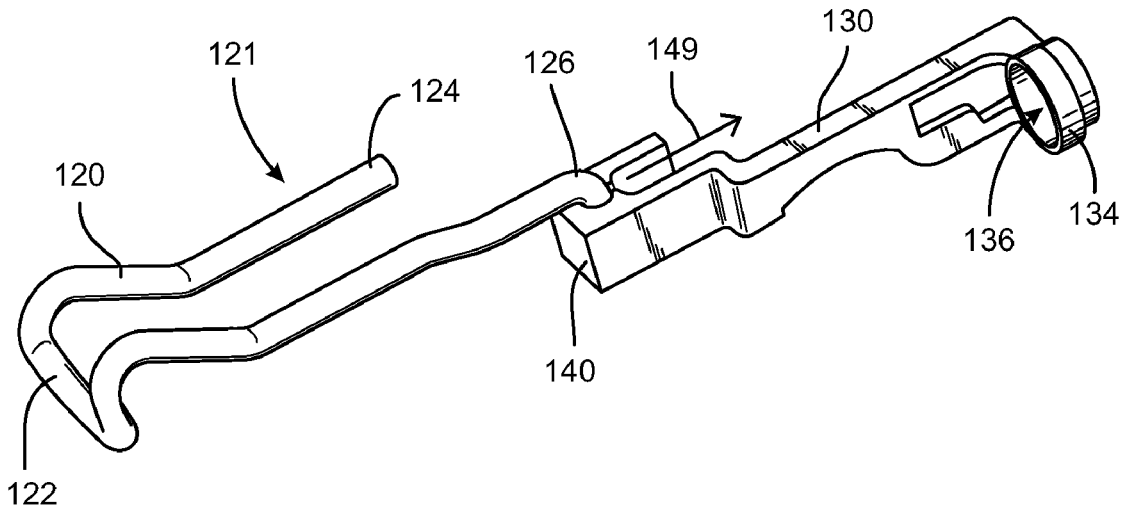
FIG. 7 depicts an isolated perspective view of an alternative embodiment of the work contact assembly of FIG. 3 where the extension member includes an end portion that provides a clip.
Figure 8:
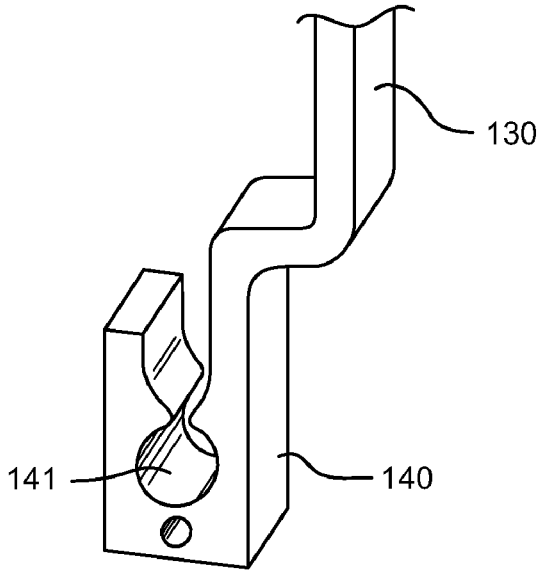
FIG. 8 depicts an isolated perspective view of the end portion of the extension member of FIG. 7.

As described above with reference to FIGS. 2-6, the WCE assembly 121 provided herein allows the WCE 120 to be released from the extension member 130 when a force greater than a threshold force is applied to the WCE. However, it will be recognized that the embodiment of FIGS. 2-6 is but one example of a WCE assembly with a releasable connection arrangement. An exemplary alternative embodiment of a WCE assembly with a releasable connection arrangement is shown in FIGS. 7 and 8. In particular, FIGS. 7 and 8 show an alternative releasable connection arrangement where the knob of the extension member of FIG. 3 is replaced with a resilient spring clip 140. In this embodiment the end 126 of the WCE is bent and engages a partially open channel 141 of the spring clip 140. However, when the WCE encounters an impact force greater than the threshold force, the WCE 120 is forced out of the channel 141 in the direction of arrow 149, and the impact force is absorbed by the nose of the tool 100. Although FIGS. 7 and 8 show another alternative embodiment of a releasable connection arrangement between the WCE and the extension member, it will be recognized that any number of different releasable connection arrangements could be used between the WCE and the WCE extension member.

Figure 9:
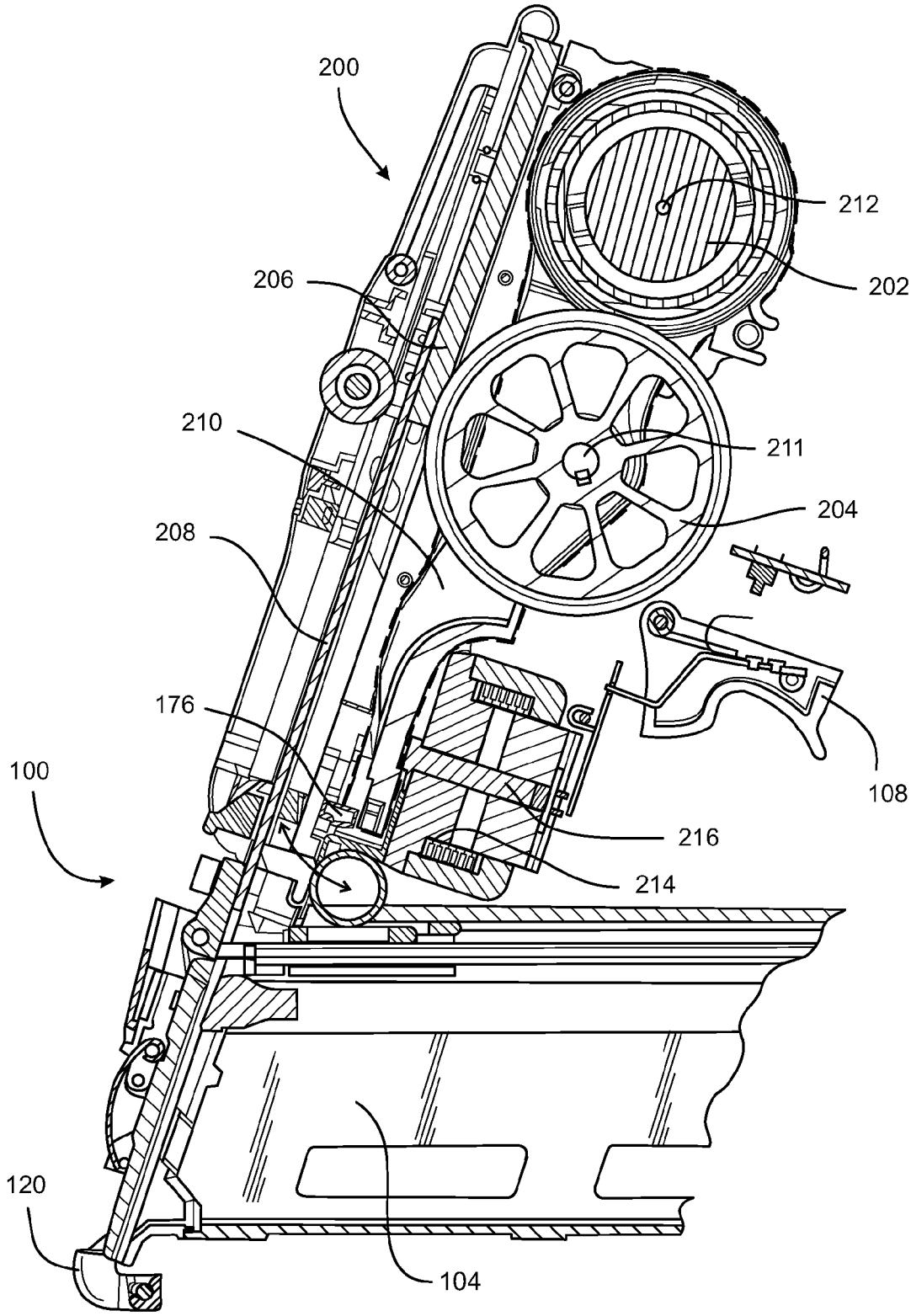
FIG. 9 shows a cutaway side view of the fastener driver of FIG. 1 including a driver assembly.

With the WCE assembly 121 and the releasable connection arrangement described above, general operation the WCE assembly 121 in association with other tool components will now be described with reference to FIG. 9. In the embodiment of FIG. 9, the tool 100 includes a drive assembly 200 having a DC motor 202, a flywheel 204, a drive block 206, a drive blade 208. The flywheel 204 is positioned on a pivotable mount 210 (highlighted with dotted lines in FIG. 9) and is configured to rotate about pivot axis 211. The mount 210, in turn, is configured to pivot about a pivot point 212.

When the WCE 120 is in the extended position, the drive assembly 200 is prevented from firing a fastener from the tool using any of various lockout or drive prevention arrangements known in the art. For example, when the WCE is in the extended position, the driver assembly 200 may be prevented from moving in some manner that prevents the tool from firing. However, when the WCE 120 is depressed, the lockout or drive blocking arrangement is reconfigured to allow the drive assembly 200 to become functional and fire a fastener from the tool. In the embodiment of FIG. 9, the tool 100 includes a drive prevention arrangement in the form of a blocking arm 176 that moves when the WCE 120 is moved. In particular, the blocking arm moves between a first position that blocks the mount 210 from pivoting and a second position where the mount 210 is allowed to pivot.

During normal operation of the tool, the user first moves the WCE 120 to the depressed position using a force that is less than the threshold force. With the WCE 120 in the depressed position, the user pulls the trigger 108, the DC motor 202 is energized and power is transmitted to the flywheel 204 via a drive belt. Once a predetermined flywheel speed has been reached, a solenoid 214 is energized, causing a plunger 216 to move into contact with the mount 210. The plunger 216 forces the mount 210 and rotating flywheel 204 to pivot toward the drive block 206. When the rotating flywheel 204 comes into contact with the drive block 206, the drive block 206 and connected drive blade 208 are propelled toward the nose. When the drive block 206 and blade 208 are fired, drive blade 208 impacts the fastener positioned at the end of the magazine 104 and expels the fastener from the device 100. Although the drive assembly of FIG. 9 includes a DC motor and flywheel, it will be recognized that any of various other drive assemblies are possible.

Although the fastening tool with releasable work contact element has been described with respect to certain preferred embodiments, it will be appreciated by those of skill in the art that other implementations and adaptations are possible. For example, although embodiments of the releasable connection between the WCE on the WCE arm have been described above as including clips, other embodiments without clips are possible. In one embodiment, a shear pin is used to connect the WCE and the WCE arm. In this embodiment, an impact force greater than the threshold force breaks the pin and causes the WCE to release from the WCE arm. It will be recognized that numerous other embodiments are also possible. Moreover, there are advantages to individual advancements described herein that may be obtained without incorporating other aspects described above. Therefore, the spirit and scope of the appended claims should not be limited to the description of the preferred embodiments contained herein.

What is claimed is:

1. A tool for driving fasteners, the tool comprising:

a work contact element configured to move between a first position and a second position, wherein the tool is prevented from driving fasteners when the work contact element is in the first position; and an extension member rigidly connected to the work contact element in a releasable connection arrangement, the releasable connection arrangement configured to maintain a rigid connection between the work contact element and the extension member during normal operation of the tool, and the releasable connection arrangement configured to release the rigid connection between the work contact element and the extension member during high impact events that are not associated with normal operation of the tool;

wherein the extension member includes an extension arm;

wherein the extension arm includes a channel configured to receive the work contact element; and wherein the work contact element includes at least one groove, the groove positioned outside of the channel when the rigid connection is maintained between the work contact element and the extension arm; and further comprising a clip configured to engage the groove on the work contact element and establish a rigid connection between the work contact element and the extension member during normal operation of the tool.

2. The tool of claim 1 wherein the high impact events include events where a force in excess of a threshold force is applied to the work contact element.

3. The tool of claim 1 wherein the channel is a bore formed in a knob on an end of the extension member.

4. The tool of claim 1 wherein the channel is a partially open channel provided by a spring clip on an end of the extension member.

5. The tool of claim 1 wherein the clip is an E-ring or a C-ring.

6. A tool for driving fasteners, the tool comprising:

a driver assembly configured to fire one of the fasteners from the tool;

a work contact element configured to move in a linear direction between an extended position and a depressed position, wherein the tool is prevented from firing fasteners unless the work contact element is in the depressed position; and an extension member releasably connected to the work contact element and configured to move in the linear direction with the work contact element, the work contact element releasable from the extension member such that the work contact element moves relative to the extension member when a force greater than a threshold force is applied to the work contact element;

wherein the extension member comprises an extension arm; and wherein the work contact element includes an end portion positioned in a channel of the extension arm; and further comprising a clip releasably connected to the work contact element and configured to rigidly connect the work contact element to the extension arm, the clip further configured to release the work contact element from the rigid connection with the extension arm when the force greater than the threshold force is applied to the work contact element;

wherein the clip is a C-ring or an E-ring configured to engage a groove in the work contact element.

7. The tool of claim 6 wherein the clip comprises a first clip positioned on a first side of the channel of the extension arm, the tool further comprising a second clip releasably connected to the work contact element on a second side of the channel.

8. The tool of claim 6 wherein the channel is configured such that the work contact element slides within the channel of the extension arm when the force greater than the threshold force is applied to the work contact element.

9. The tool of claim 6 wherein the releasable connection between the work contact element and the extension member is a releasable rigid connection such that the work contact element remains slideably connected to the extension member when the force greater than the threshold force is applied to the work contact element.

10. The tool of claim 6 wherein the clip is a spring clip positioned on an end portion of the extension arm, the spring clip configured to releasably engage the work contact element.

* * * * *